US011230892B2

(12) United States Patent
Baynham et al.

(10) Patent No.: US 11,230,892 B2
(45) Date of Patent: Jan. 25, 2022

(54) MODIFIED TUBULAR

(71) Applicant: Maxwell Oil Tools Ltd, Aberdeen (GB)

(72) Inventors: Richard Ronald Baynham, Marina di Ravenna (IT); David Elrick Yule Levie, Kastanienbaum (CH)

(73) Assignee: X-Holding GmbH, Herford (DE)

( * ) Notice: Subject to any disclaimer, the term of this patent is extended or adjusted under 35 U.S.C. 154(b) by 0 days.

(21) Appl. No.: 17/048,068

(22) PCT Filed: Apr. 15, 2019

(86) PCT No.: PCT/GB2019/051071
§ 371 (c)(1),
(2) Date: Oct. 15, 2020

(87) PCT Pub. No.: WO2019/202301
PCT Pub. Date: Oct. 24, 2019

(65) Prior Publication Data

US 2021/0079740 A1 Mar. 18, 2021

(30) Foreign Application Priority Data

Apr. 16, 2018 (GB) ..... 1806175

(51) Int. Cl.
*E21B 17/10* (2006.01)

(52) U.S. Cl.
CPC ..... *E21B 17/1042* (2013.01)

(58) Field of Classification Search
CPC ..... E21B 17/105; E21B 17/1042; E21B 17/1078; E21B 17/10
See application file for complete search history.

(56) References Cited

U.S. PATENT DOCUMENTS 4,083,612 A * 4/1978 Olson ..... E21B 4/003 175/325.3
5,069,297 A * 12/1991 Krueger ..... E21B 17/105 175/65
5,833,018 A * 11/1998 von Gynz-Rekowski ..... E21B 17/1064 175/325.3
5,901,798 A * 5/1999 Herrera ..... E21B 17/1085 175/325.3

(Continued)

*Primary Examiner* — Shane Bomar
(74) *Attorney, Agent, or Firm* — Jones Walker LLP

(57) ABSTRACT

A modified tubular, particularly a drill pipe (12) has a composite non-rotating drill pipe protector assembly (1) including first and second composite collars (2, 3) provided as cooperating parts positionable around the drill pipe (12) and bondable thereto using bonding agent, a non-rotating composite protector shell (4), provided as cooperating shell parts and an internal polymeric radial bearing (7) which fits within a recess (41) within the non-rotating composite protector shell (4) and has an internal surface (10) configured to provide a plurality of internal fluid flow channels (11). An external surface of the non-rotating composite protector shell (4) has blades (14), spaced apart by fluid flow by-pass channels (24). In use the rotation of the drill pipe facilitates fluid movement within the non-rotating composite protector shell by creating a pumping effect inducing ingress of fluid and through-flow within the internal polymeric radial bearing (7).

10 Claims, 4 Drawing Sheets

(56) References Cited

U.S. PATENT DOCUMENTS

| | | | | |
|---|---|---|---|---|
| 6,739,415 | B2 * | 5/2004 | Mitchell | E21B 17/1007 175/325.5 |
| 8,119,047 | B2 * | 2/2012 | Moore | E21B 17/12 264/242 |
| 8,511,377 | B2 * | 8/2013 | Casassa | E21B 17/1057 166/241.6 |
| 8,800,664 | B2 * | 8/2014 | Gollmyer | E21B 17/1064 166/350 |
| 8,905,161 | B2 * | 12/2014 | Tverlid | E21B 17/04 175/325.3 |
| 9,534,456 | B2 * | 1/2017 | Eidem | E21B 17/105 |
| 2016/0130886 | A1 * | 5/2016 | Simpson | E21B 4/003 175/325.3 |

* cited by examiner

MODIFIED TUBULAR

The disclosure relates to a modified tubular for use in drilling wellbores.

BACKGROUND

Oil and gas reservoirs may be exploited by tapping the resources therein via wellbores. Drilling of wellbores may require drilling a considerable distance into the earth. Many oil & gas bearing formations are at sub-sea locations. The direction of drilling may deviate from a vertical position to a horizontal position so that the drill can form a deviated wellbore extending laterally for some considerable distance from the original wellbore entry. In this way reservoirs far from the drilling rig can be accessed using deviated wellbores. The wellbore created by drilling may be stabilised by use of appropriately sized tubular casing or lining, or by other measures. Therefore in the course of forming a wellbore, the drill string can be run in and out several times and between drilling operations tubular casing can be installed to preserve the integrity of the drilled wellbore.

Drilling is conducted using strings assembled from stands of tubular drill pipe with a formation material removal assembly at the lower end of the string to form a wellbore by formation material removal, the removed material being typically flushed to surface with circulating drilling fluid. The deviations of the drill string to access the target reservoir often causes considerable contact between side portions of the drill string and the formation resulting in undesirable wear on portions of the tubular drill pipe making up the drill string and additional energy demands to overcome the additional frictional loadings on the drill string.

Tubular drill pipe is of a uniform diameter throughout most of its length but typically has wider "upset" regions at either end to form respectively male "pin" and female "box" threaded tool joint connections ("tool joints") for fixing one tubular drill pipe to the next. These larger diameter upset regions can present a difficulty when trying to find a solution to the drill pipe wear problem.

A known device for addressing this problem is a non-rotating protector which is an elongate sleeve assembly mechanically attached around the tubular drill pipe to preferentially contact the formation, and including internal passages to admit drilling fluid to form a thin film providing lubrication between the sleeve inner surface and the drill pipe external surface thereby allowing the tubular drill pipe to rotate within the sleeve assembly whenever the sleeve contacts the surface of a well bore or casing. Thus when a deviated path is taken by the drill string any contact with the formation is preferentially made by one of these sleeve assemblies rather than a portion of the tubular drill pipe in the drill string. In effect the outer surface of the sleeve assembly when coming into contact with the formation stops turning with the drill string, but the drill string can turn within it due to the slippage permitted by the reduced frictional drag due to the presence of the fluid film, thereby alleviating a significant amount of loading in comparison with an unprotected drill string. Typically multiple sleeve assemblies would be mounted throughout the length of the drill string, usually close to each tool joint.

Such a sleeve assembly is disclosed in U.S. Pat. No. 5,069,297, where a longitudinally split drill pipe protector sleeve is described which is of larger diameter than a drill pipe/tool joint. The longitudinally split drill pipe protector sleeve may be of nitrile rubber reinforced with an embedded metal cage. The split drill pipe protector sleeve may be spread apart, presented to a portion of the drill pipe to be protected, closed around that portion of the drill pipe and fastened. Upper and lower thrust bearings, which may be split plastic collars can be clamped on either side of the split drill pipe protector sleeve to maintain a desired axial position for the split drill pipe protector sleeve upon the drill pipe. In a disclosed embodiment longitudinal fluid flow channels on the internal surface have wedge-shaped or tapered shoulders contacting the drill pipe to urge fluid passing through the longitudinal fluid flow channels out the channels, over the tapered shoulders and pass between the split drill pipe protector sleeve and the outer diameter of the drill pipe, creating a lubricating fluid film therebetween. Circulating drilling fluid can thereby readily penetrate to form a certain clearance between the split drill pipe protector sleeve and the drill pipe to reduce frictional drag thereby allowing a certain relative motion between the split drill pipe protector sleeve and the drill pipe which may act to reduce the effect of contact with formation or casing by allowing the drill pipe to rotate within the split drill pipe protector sleeve even though the split drill pipe protector sleeve may be dragging on the formation or casing.

SUMMARY

A non-rotating drill pipe protector assembly for a drill pipe is disclosed herein which is formed from composite materials. The composite non-rotating drill pipe protector assembly comprises first and second composite collars, each of the first and second composite collars comprising cooperating parts fastenable together, for example by bonding, to form the first and second composite collars around a drill pipe at axially spaced positions. The composite non-rotating drill pipe protector assembly further comprises a non-rotating composite protector shell also formed from multiple cooperating parts and fastenable together to form a generally cylindrical shell surrounding the drill pipe, and positionable between the first and second composite collars. The non-rotating composite protector shell contacts first and second polymeric resin thrust bearings, and is mounted on an internal polymeric radial bearing formed from cooperating parts positionable within the non-rotating composite protector shell to form a generally cylindrical radial bearing sleeve having first and second ends and an internal surface configured to provide a plurality of fluid flow channels. In use the internal polymeric radial bearing is positionable within the non-rotating composite protector shell about the drill pipe. The non-rotating composite protector shell may have internal ribs for engaging with edge portions of the internal polymeric radial bearing such that the non-rotating composite protector shell and the internal polymeric radial bearing are keyed together as one when assembly is complete. The non-rotating composite protector shell is retained in a selected axial position upon a drill pipe between respective first and second polymeric resin thrust bearings which are seated within the first and second composite collars, the first and second composite collars being fixable to the drill pipe by means of a bonding agent. The first and second composite collars respectively may have an internal cavity for receiving a bonding agent, which cavity confronts the drill pipe when the respective collars are positioned upon the drill pipe. The first and second collars respectively may have at least one port on an external surface for injection of bonding agent.

The cooperating parts of the respective composite collars, first and second polymeric resin thrust bearings, non-rotating composite protector shell, and internal polymeric radial bearing, are each configured to be placed around a drill pipe and conveniently are provided in multiple parts designed to be positioned together to form the whole, and thus are broadly part cylindrical so as to surround the drill pipe when assembled together.

The first and second composite collars may respectively have a length aligned with longitudinal axis of the drill pipe in use. The first and second composite collars may respectively have a tapered or chamfered end, and respectively an opposite end which in the non-rotating drill pipe protector assembly faces an edge of the non-rotating composite protector shell, and is at least partially recessed or apertured. The first and second composite collars respectively may have at said opposite end, a plurality of recessed edge formations, for example part circular openings, such as inverted scalloped portions, or other recesses or apertures for admitting ingress of fluid. The fluid ingress may flow via circumferentially spaced ports in the respective first and second ends of the non-rotating composite shell to permit fluid lubrication of at least the internal polymeric radial bearing via the plurality of fluid flow channels with respect to the drill pipe. Sequential fluid ingress, flow within the fluid flow channels of the internal polymeric radial bearing, and fluid egress therefrom is facilitated by the rotation of the drill pipe within the non-rotating composite shell and internal polymeric radial bearing, which rotation provides a pumping action.

The non-rotating drill pipe protector assembly can be pre-fabricated about a drill pipe under controllable manufacturing conditions in a composite material handling and assembly plant before the drill pipe is delivered to the field. The prefabricated protected drill pipe is then deliverable in a ready for use condition. Alternatively, the non-rotating drill pipe protector assembly could be attached to drill pipe on site within a suitable workshop providing sufficient protection from external environmental conditions for the composite material handling and bonding operations required. The non-rotating drill pipe protector assembly may be provided in a lightweight ready-to-assemble kit form including bonding agents for on-site attachment of the assembly to drill pipe.

The non-rotating composite protector shell may have an external surface configured to have raised portions, such as blades, which are spaced apart by fluid flow by-pass channels. The raised portions around the non-rotating composite protector shell present the widest radial dimension of the non-rotating drill pipe protector assembly, and thus, in use, would preferentially contact a wellbore wall in a formation or casing thereby tending to effectively minimise damaging contact of the drill pipe with the wellbore wall in a formation or casing. The blades may be aligned with the longitudinal axis of the drill pipe (straight blades), or follow a curved or twisted configuration around the external surface of the non-rotating composite protector shell (spiral blades).

External surfaces of the composite material components comprise a low friction low wear ceramic composite layer. This low friction low wear ceramic composite layer may comprise epoxy resin/carbon fibre composite materials with low friction wear-resistant external surfaces of Kevlar matrix resin with $ZrO_2$ or resin bonded carbon fibre/Kevlar fibres .$ZrO_2$ particulates. The matrix may have a honeycomb structure.

In use the rotation of the drill pipe facilitates fluid movement within the non-rotating composite protector shell by a creating a pumping effect inducing ingress of fluid and through flow within the internal polymeric radial bearing.

Use of the non-rotating drill pipe protector assembly for a drill pipe as disclosed herein reduces torque loadings, mitigates casing wear and prolongs the working life of drill pipe during drilling operations.

Illustrative embodiments will now be described by way of non-limiting example with reference to the accompanying drawings.

DESCRIPTION OF THE DRAWINGS

FIGS. 2*a* and 2*b* show a part of the internal polymeric radial bearing, wherein FIG. 2*a* shows a side elevation illustrating the part cylindrical outer surface, and FIG. 2*b* shows the internal surface which is configured to provide a plurality of fluid flow channels;

DESCRIPTION OF EMBODIMENTS

Figure 1:
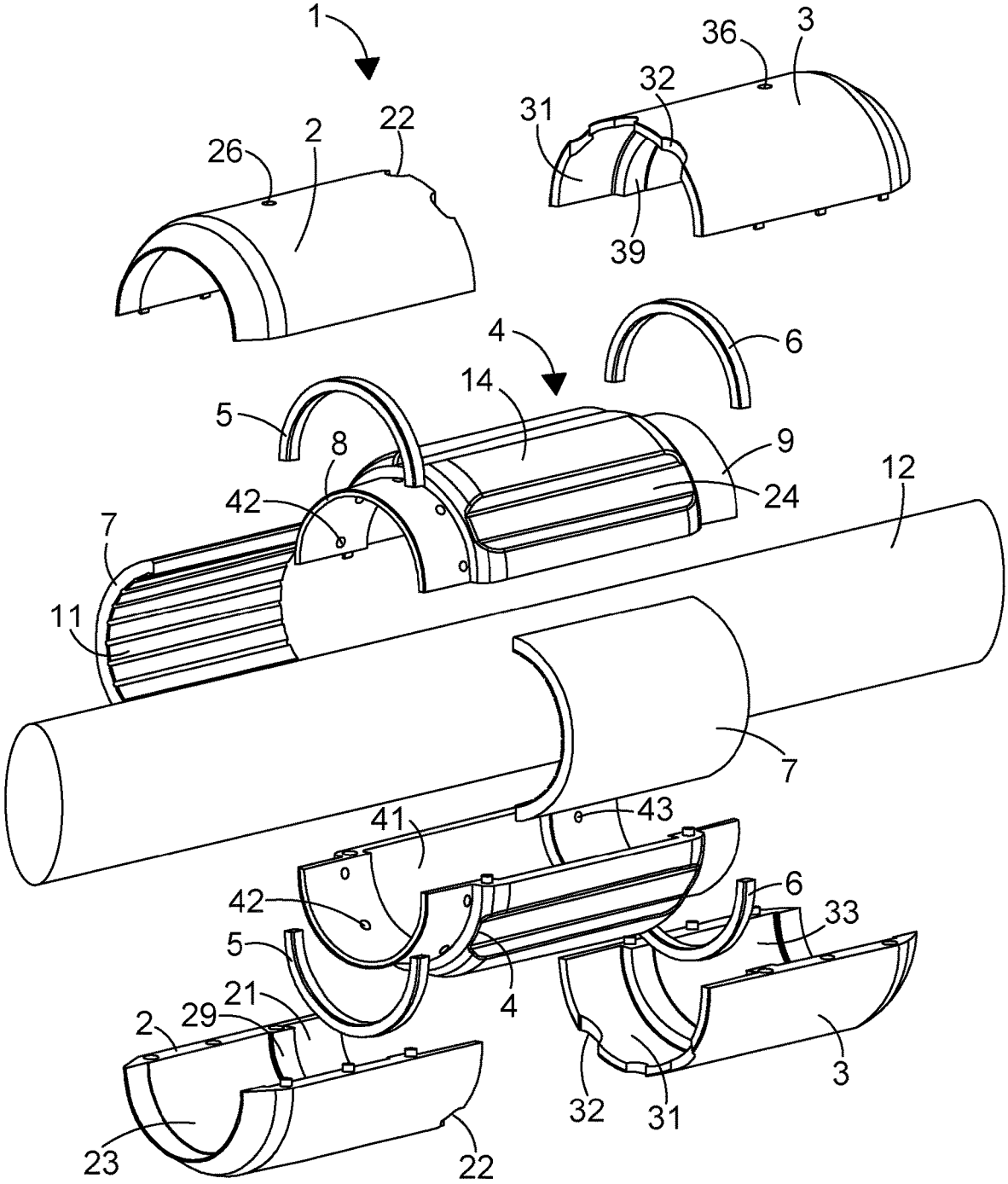
FIG. 1 shows an exploded view of the non-rotating drill pipe protector assembly juxtaposed with a portion of drill pipe.
Figure 2A:
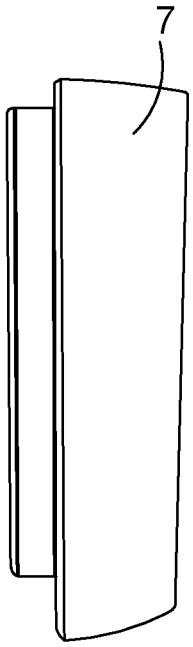
Figure 2B:
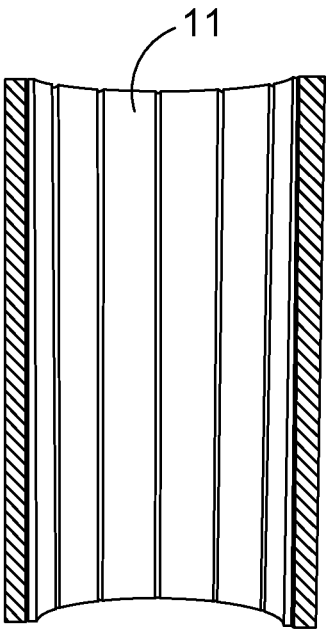
Figure 3:
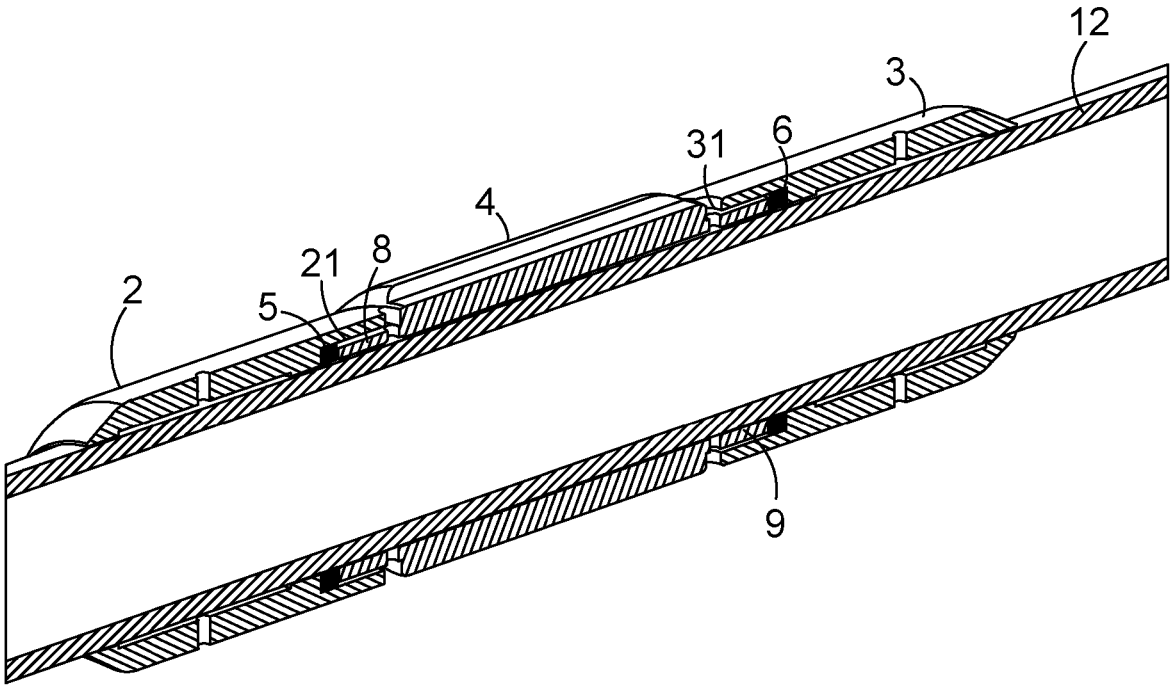
FIG. 3 shows a side section through the non-rotating drill pipe protector assembly attached to a portion of drill pipe.
Figure 4:
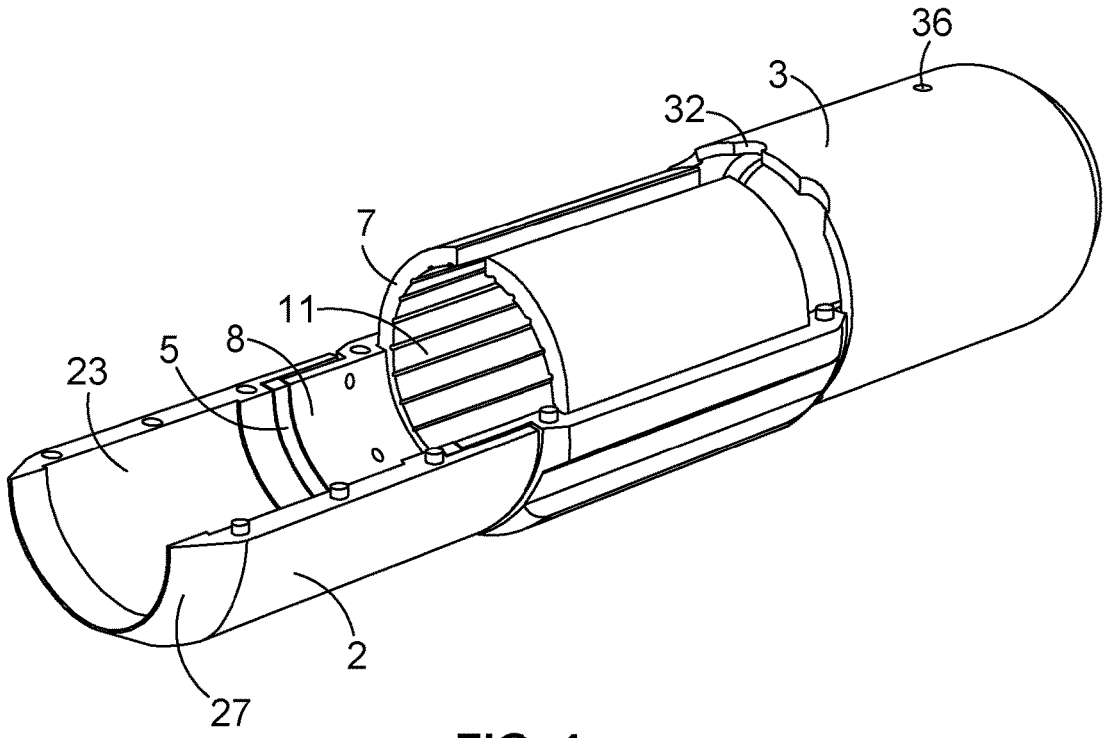
FIG. 4 is a perspective view of a part-assembled non-rotating drill pipe protector assembly without the presence of a drill pipe for illustration purposes to show the positioning of the internal polymeric radial bearing within non-rotating composite protector shell.
Figure 5:
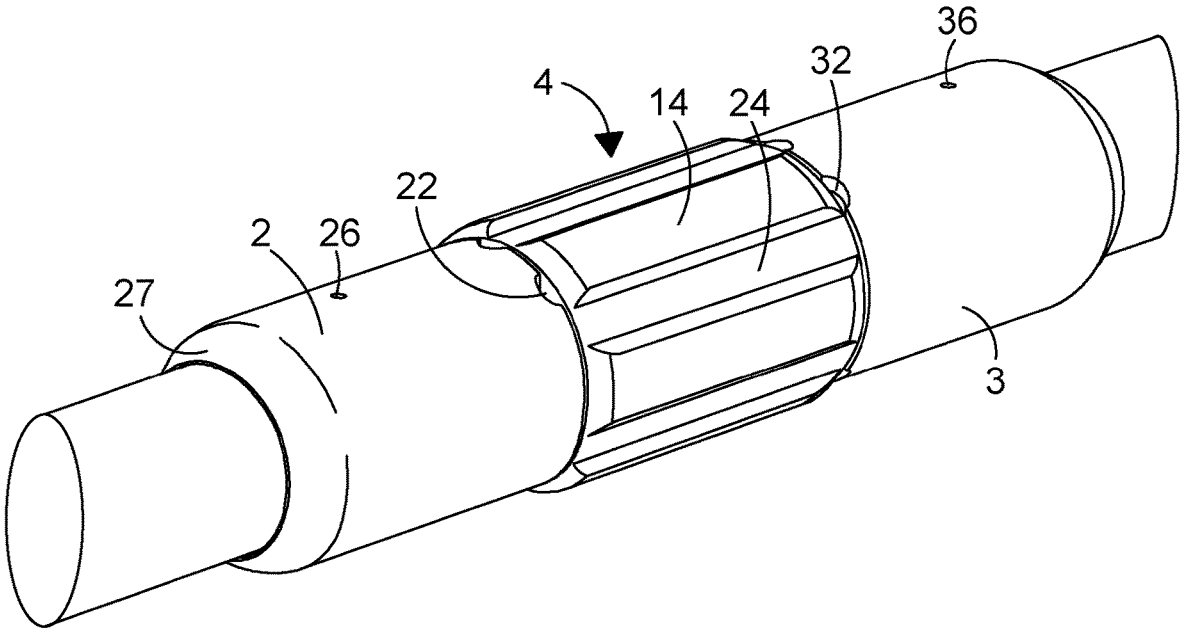
FIG. 5 shows a perspective view of the completed non-rotating drill pipe protector assembly mounted on a portion of drill pipe.
Figure 6:
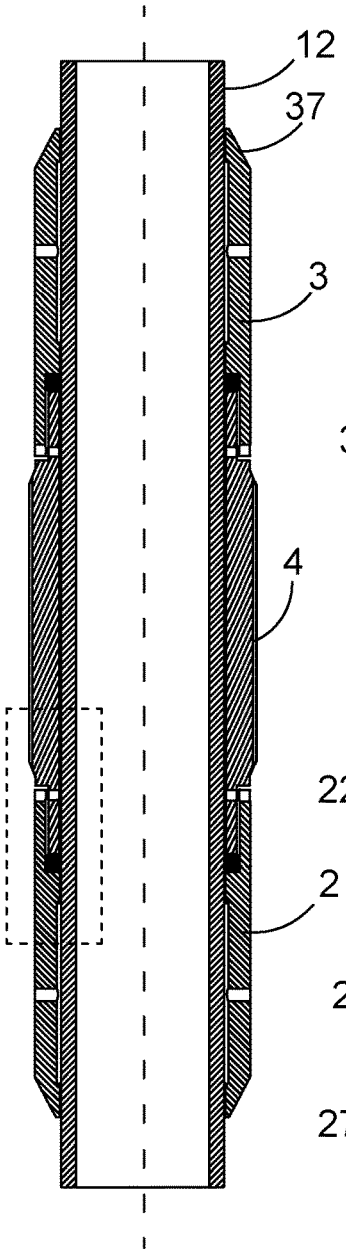
FIG. 6 is a longitudinal side section through a portion of drill pipe protected by a non-rotating drill pipe protector assembly as disclosed herein.
Figure 7:
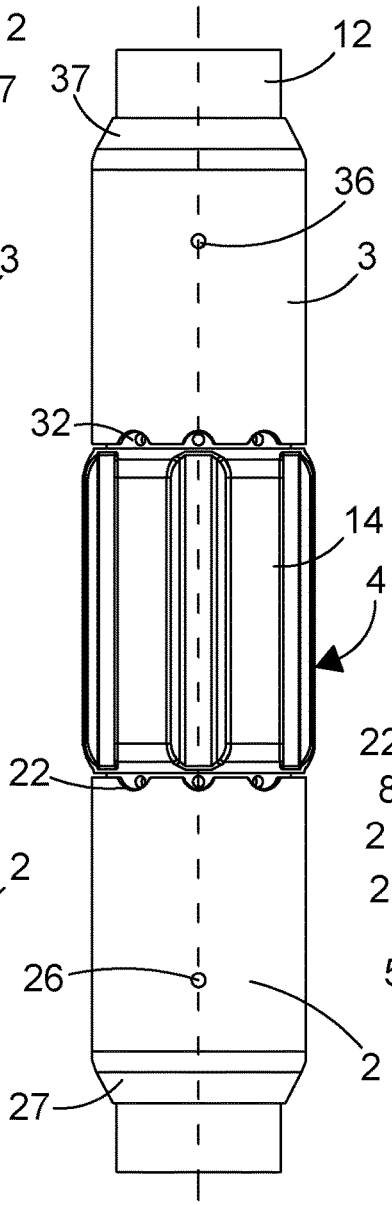
FIG. 7 is a longitudinal side view of a non-rotating drill pipe protector assembly mounted on a portion of drill pipe.
Figure 8:
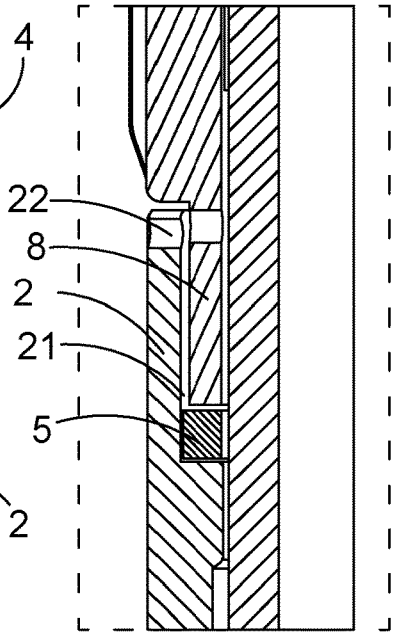
FIG. 8 is a side section, on an enlarged scale, through part of the non-rotating drill pipe protector assembly shown in FIG. 6, illustrating the assembled configuration of the non-rotating composite protector shell in contact with a polymeric resin thrust bearing, and a composite collar.
Figure 9:
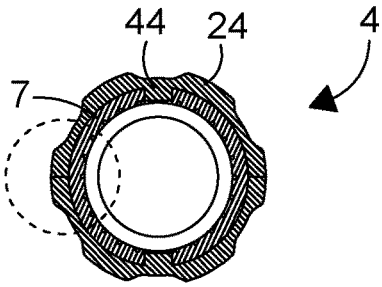
FIG. 9 is a cross-section through a portion of drill pipe within the internal polymeric radial bearing and non-rotating composite protector shell of the a non-rotating drill pipe protector assembly as shown in FIG. 6.
Figure 10:
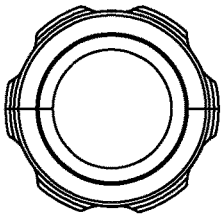
FIG. 10 is an end view of the non-rotating drill pipe protector assembly mounted on a portion of drill pipe as shown in FIG. 7.
Figure 11:
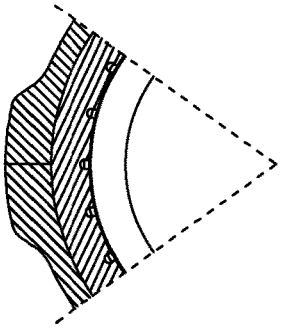
FIG. 11 is a partial cross-section, on an enlarged scale, through a portion of drill pipe within the internal polymeric radial bearing and non-rotating composite protector shell of the a non-rotating drill pipe protector assembly as shown in FIG. 6 and showing detail of some of the internal fluid flow channels, and the profile of an axial blade on the non-rotating composite protector shell.

Referring to FIG. 1, a composite non-rotating drill pipe protector assembly 1 for a drill pipe 12 includes first and second composite collars 2, 3 provided as cooperating parts (in this embodiment interlocking half shells) positionable around the drill pipe 12 and bondable thereto using a bonding agent to form the respective first and second composite collars 2, 3. The non-rotating drill pipe protector assembly 1 further includes a non-rotating composite protector shell 4, provided as cooperating parts (in this embodiment interlocking half shells) and an internal polymeric radial bearing 7 which fits within a recess 41 (FIG. 1) within the non-rotating composite protector shell 4 (see FIGS. 4 and 9). The non-rotating composite protector shell 4 has an external surface with a plurality of raised surfaces forming blades 14, spaced apart by fluid flow by-pass channels 24. The non-rotating composite protector shell 4 also has first and second ends 8, 9 of reduced diameter configured for fitting under corresponding recess surfaces 21, 31 of the first and second composite collars 2, 3. The internal polymeric radial bearing has an internal surface 10 configured to provide a plurality of internal fluid flow channels 11.

The non-rotating composite protector shell 4 may have internal ribs 44 for engaging with edge portions of the internal polymeric radial bearing 7 such that the non-rotating composite protector shell 4 and the internal polymeric radial bearing 7 are keyed together as one when assembly is complete.

First and second polymeric resin thrust bearings 5, 6 are respectively provided as cooperating parts (split rings) to be fitted in contact with the first and second ends 8, 9 of the non-rotating composite protector shell 4 and within the recess surfaces 21, 31 of the first and second composite collars 2, 3.

The first and second composite collars 2, 3 may respectively have a tapered or chamfered end 27, 37.

The first and second composite collars 2, 3 respectively have a plurality of part circular apertures 22, 32 for admitting ingress of fluid via circumferentially spaced ports 42, 43 in the respective first and second ends 8, 9 of the non-rotating composite shell 4 to permit fluid lubrication of at least the internal polymeric radial bearing 7 via the plurality of fluid flow channels 11 with respect to the drill pipe 12.

The first and second composite collars 2, 3 respectively may have an internal cavity 23, 33 for receiving a bonding agent, which cavity confronts the drill pipe 12 when the respective collars 2, 3 are positioned upon the drill pipe 12. The first and second collars respectively may have at least one port 26, 36 on an external surface for injection of bonding agent.

The respective internal cavity 23, 33 is separated from fluid flow space under the recess surfaces 21, 31 by a dividing wall 29, 39.

In use, the internal polymeric radial bearing 7 is positionable within the recess 41 of the non-rotating composite shell 4 about the drill pipe 12, and retained in a selected axial position upon a drill pipe 12 between respective first and second polymeric resin thrust bearings 5, 6 and the first and second composite collars 2, 3, the first and second composite collars 2, 3 being fixable to the drill pipe 12 by means of a bonding agent whilst the non-rotating composite protector shell 4 and internal polymeric radial bearing 7 is not fixed to the drill pipe 12 and is free to rotate relative to the drill pipe 12. In practice, in the absence of contact with a wall of a wellbore or casing there would be no or negligible relative rotation of the non-rotating composite protector shell 4 relative to the drill pipe 12. However in the course of drilling, especially during deviated drilling, the non-rotating composite protector shell 4 may drag upon the wall of a wellbore or casing but the drill pipe (drill string) continues to rotate due to the presence of the internal polymeric radial bearing 7 within non-rotating composite protector shell 4. Thus the problems of undesirable wellbore contact causing wear, friction and excess power demands are addressed by the disclosed composite non-rotating drill pipe protector assembly 1.

FIG. 1 also represents the components required for a kit to assemble the disclosed non-rotating drill pipe protector upon a drill pipe. Bonding agents and optional drill pipe surface cleaning materials would also be present in the ready for use kit.

In FIGS. 2-11, where appropriate, like parts are indicated by the same call out numerals as used in FIG. 1.

The composite material components for the non-rotating drill pipe protector assembly can be manufactured in moulds designed and constructed according to the finished component shape requirements. Thus the mould can be used to pre-fabricate the composite materials into components required to assemble the non-rotating drill pipe protector assembly.

In an embodiment for manufacturing such a component, a layer of fibrous mat may be infused with a resin matrix. This may be achieved by passing the fibrous mat through a bath containing the resin matrix. Infusion may also be achievable in other ways, such as applying the resin matrix liberally to the fibrous mat by pouring or spraying or by a pressure treatment to soak, or impregnate the fibrous mat with the resin matrix.

Ceramic particulates, for example hard wearing materials such as a combination of zirconium dioxide and/or silicon nitride, optionally in bead form, may be applied to the resin matrix infused fibre mat.

A friction modifying material such as fluorocarbon particulates providing a low friction coefficient also may be applied to the resin matrix infused mat.

The resin matrix infused fibre mat may be introduced to the mould such that surfaces treated with the aforesaid particulates are adjacent to the mould surfaces so that these particulates are on an external surface of the moulded component. Multiple additional layers of the resin matrix infused fibre mat, which may or may not each have been treated with particulates, may be laid up into the mould on to the first resin matrix infused fibre mat lining the mould until a predetermined thickness is attained.

Then the mould may be closed.

A resin filler matrix may be introduced into the mould using a low pressure resin transfer moulding process. In an example of such a process, a mixed resin and catalyst or resin curing agent are introduced, for example by injection, into a closed mould containing a resin matrix infused fibrous mat and particulates lay-up. In this way a composite component may be formed.

The mould may be heated in order to achieve first cure.

After sufficient curing of the resin to permit handling of the component, the mould can be opened and the formed component removed.

If necessary a post cure of the formed component may be carried out. Post cure may be a heat treatment, for example conducted in an oven.

Conveniently the composite material components are moulded in parts for subsequent assembly, for example as complementary cooperating half-shells. The half shells may have facing edge projections such as pegs for engaging with corresponding opposite sockets so as to properly locate, key and fit the shell parts together.

The composite materials used for components of the composite non-rotating drill pipe protector assembly may be may be formed from a fibre-reinforced resin material (FRP/GRP/GFK type material). The resin material can be a hardenable resin optionally including curing agents and curing modifiers. The resin may be self-curing, or provided in two components which harden when brought together. The two component system may be a matrix-forming (prepolymer) component and a hardener. Suitable resins include epoxy resins, polyurethanes and polyurea resins including blends or hybrids thereof, and other curable resin components including polyester or polyol or polyamine components. The curing of the resin may be controlled by use of amine curing agents such as polyetheramines. Other additives may be present. The composite materials may be based on microcrystalline cellulose composites, optionally including polyurethanes. External surfaces of the components formed from composite materials, and especially the non-rotating composite protector shell 4 of the non-rotating drill pipe protector assembly, comprise a low friction low wear ceramic composite layer. This low friction low wear ceramic composite layer may comprise epoxy resin/carbon fibre composite materials with low friction wear-resistant external surfaces of Kevlar matrix resin with $ZrO_2$ or resin bonded carbon fibre/Kevlar fibres .$ZrO_2$ particulates. The matrix may have a honeycomb structure.

The polymeric resin materials used for bearing parts may be based on durable, low friction polymers such as aramid fibre reinforced polyamide composites optionally with or without polytetrafluoroethylene modification. The bearing parts may be modified with boron nitride for example introduced as nanoparticles to the polymeric resin materials.

The invention claimed is:

1. A composite non-rotating drill pipe protector assembly for a drill pipe, the composite non-rotating drill pipe protector assembly comprising first and second composite collars, a non-rotating composite protector shell having first and second ends, first and second polymeric resin thrust bearings, an internal polymeric radial bearing having an internal surface configured to provide a plurality of fluid flow channels, the internal polymeric radial bearing being positionable within the non-rotating composite shell between the first and second ends and about the drill pipe, and retained in a selected axial position upon the drill pipe between respective first and second polymeric resin thrust bearings and the first and second composite collars, the first and second composite collars being fixable to the drill pipe by means of a bonding agent.

2. A composite non-rotating drill pipe protector assembly according to claim 1, wherein the first and second composite collars respectively have an internal cavity for receiving a bonding agent, which cavity confronts the drill pipe when the respective collars are positioned upon the drill pipe, and the first and second collars respectively have at least one port on an external surface for injection of the bonding agent into the respective cavity.

3. A composite non-rotating drill pipe protector assembly according to claim 1, wherein at least some of the plurality of fluid flow channels on the internal surface of the internal polymeric radial bearing are aligned axially with the longitudinal axis of the drill pipe.

4. A composite non-rotating drill pipe protector assembly according to claim 1, wherein the first and second composite collars provide substantially seamless collars surrounding the drill pipe when fixed to the drill pipe by means of a bonding agent.

5. A composite non-rotating drill pipe protector assembly according to claim 1 wherein the first and second composite collars have apertures for admitting ingress of fluid to permit fluid lubrication of at least the internal polymeric radial bearing via the plurality of fluid flow channels with respect to the drill pipe.

6. A wear protected drill pipe comprising at least one composite non-rotating drill pipe protector assembly according to claim 1 bonded to the drill pipe by means of a bonding agent.

7. A kit for assembly of a composite non-rotating drill pipe protector assembly upon a drill pipe, the composite non-rotating drill pipe protector assembly comprising first and second composite collars respectively provided in cooperating parts fastenable together about the drill pipe, a non-rotating composite protector shell provided in cooperating parts fastenable together and having first and second ends, first and second polymeric resin thrust bearings respectively provided in cooperating parts fastenable together, an internal polymeric radial bearing respectively provided in cooperating parts and having an internal surface configured to provide a plurality of fluid flow channels, the internal polymeric radial bearing being positionable within the non-rotating composite shell between the first and second ends and about the drill pipe, and retained in a selected axial position upon the drill pipe between respective first and second polymeric resin thrust bearings and the first and second composite collars, and at least one bonding agent for fixing the first and second composite collars to the drill pipe.

8. A composite non-rotating drill pipe protector assembly according to claim 2, wherein at least some of the plurality of fluid flow channels on the internal surface of the internal polymeric radial bearing are aligned axially with the longitudinal axis of the drill pipe.

9. A composite non-rotating drill pipe protector assembly according to claim 8, wherein the first and second composite collars provide substantially seamless collars surrounding the drill pipe when fixed to the drill pipe by means of a bonding agent.

10. A composite non-rotating drill pipe protector assembly according to claim 8 wherein the first and second composite collars have apertures for admitting ingress of fluid to permit fluid lubrication of at least the internal polymeric radial bearing via the plurality of fluid flow channels with respect to the drill pipe.

* * * * *